US006776078B2

(12) United States Patent
Gawazawa

(10) Patent No.: US 6,776,078 B2
(45) Date of Patent: Aug. 17, 2004

(54) CUTTING MACHINE

(75) Inventor: Takayuki Gawazawa, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 10/263,794

(22) Filed: Oct. 4, 2002

(65) Prior Publication Data

US 2003/0070520 A1 Apr. 17, 2003

(30) Foreign Application Priority Data

Oct. 12, 2001 (JP) ..... 2001-315751

(51) Int. Cl.[7] ..... B26D 5/20
(52) U.S. Cl. ..... 83/881; 125/13.01; 125/20
(58) Field of Search ..... 83/13, 881, 76.6, 83/76.7, 452, 455; 451/361, 87, 88, 450; 125/20, 23.1, 13.1; 29/417

(56) References Cited

U.S. PATENT DOCUMENTS 4,552,192 A * 11/1985 Eaves ..... 144/136.95
4,688,540 A * 8/1987 Ono ..... 125/13.01
6,345,616 B1 * 2/2002 Umahashi ..... 125/13.01
6,494,122 B2 * 12/2002 Kamigaki ..... 83/13
6,494,197 B1 * 12/2002 Yoshimura et al. ..... 125/12
6,500,058 B2 * 12/2002 Bajo et al. ..... 451/361
6,513,694 B1 * 2/2003 Xu et al. ..... 225/96.5
6,568,385 B2 * 5/2003 Sekiya et al. ..... 125/20

* cited by examiner

*Primary Examiner*—Allan N. Shoap
*Assistant Examiner*—Ghassem Alie
(74) *Attorney, Agent, or Firm*—Smith, Gambrell & Russell, LLP

(57) ABSTRACT

A cutting machine comprising a chuck table for holding a workpiece, a spindle unit having a rotary spindle for mounting a cutting blade which cuts the workpiece held on the chuck table, and a spindle unit support mechanism for supporting the spindle unit in such a manner that it can move in a cutting direction, wherein the spindle unit support mechanism comprises a movable base, a guide rail which is provided on the movable base and has a predetermined curvature radius, a spindle unit support member which is movably disposed along the guide rail and mounts the spindle unit, and an angle adjustment mechanism for moving the spindle unit support member along the guide rail to adjust the angle.

4 Claims, 5 Drawing Sheets

CUTTING MACHINE

FIELD OF THE INVENTION

The present invention relates to a cutting machine for cutting a workpiece such as a semiconductor wafer and, more specifically, to a cutting machine capable of cutting a workpiece at a tilt angle to the plane perpendicular to the surface of the workpiece.

DESCRIPTION OF THE PRIOR ART

In the production of a semiconductor device, for example, the front surface of a substantially disk-like semiconductor wafer is divided into a plurality of rectangular areas by cutting lines called "streets" arranged in a lattice form, and a predetermined circuit pattern is formed in each of the rectangular areas. The plurality of rectangular areas having a circuit pattern are cut and separated from one another to form so-called semiconductor chips. The semiconductor wafer is cut by a precision cutting machine called "dicing machine".

The above cutting machine comprises a spindle unit having a spindle housing, a rotary spindle rotatably supported by the spindle housing and a cutting blade attached to the end of the rotary spindle and cuts a workpiece held on a chuck table along predetermined cutting lines by moving the workpiece relative to the cutting blade while rotating the cutting blade at a high speed. In this cutting machine, the cutting blade is generally positioned perpendicular to the workpiece holding face of the chuck table and therefore, the cut surface of the workpiece is formed perpendicular to the front surface and the back surface of the cut semiconductor chip.

By the way, in the step of mounting a glass diode having a rectangular shape as a semiconductor chip on a semiconductor device, care must be taken not to place the cut surface of the glass diode on the semiconductor device. That is because, when the cut surface of the semiconductor chip is perpendicular to its front surface as described above, the cut surface of the semiconductor chip is liable to be placed on the semiconductor device. To solve this problem, there is proposed a semiconductor chip whose cut surface is formed at a tilt angle with the plane perpendicular to its front surface.

In order to cut the semiconductor wafer at a tilt angle with the plane perpendicular to its front surface as described above, the cutting blade must be inclined with respect to the workpiece holding face of the chuck table. As a technology for inclining the cutting blade with respect to the workpiece holding face of the chuck table, there is employed a method of holding a workpiece on a chuck table by interposing a tilting jig therebetween.

However, according to the method of holding a workpiece on a chuck table with a tilting jig interposed therebetween as described above, the alignment step for detecting an area to be cut of the workpiece is difficult to carry out because the workpiece is held in an inclined state. Further, in the method of holding a workpiece on a chuck table with a tilting jig interposed therebetween, when the cutting direction is to be changed by 90°, the workpiece must be re-placed relative to the tilting jig. This work is troublesome and reduces productivity.

SUMMARY OF THE INVENTION

It is an object of the present invention to provide a cutting machine which make it easy to carry out the alignment step for detecting an area to be cut of a workpiece held on a chuck table, and makes it possible to cut the workpiece at a tilt angle to the plane perpendicular to the surface of the workpiece without re-placing it when the cutting direction is changed by 90°.

To attain the above object, according to the present invention, there is provided a cutting machine comprising a chuck table having a workpiece holding face for holding a workpiece, a spindle unit having a rotary spindle for mounting a cutting blade which cuts the workpiece held on the chuck table, and a spindle unit support mechanism for supporting the spindle unit in such a manner that it can move in a cutting direction perpendicular to the workpiece holding face, wherein the spindle unit support mechanism comprises a movable base which is movably disposed in a cutting direction perpendicular to the workpiece holding face, a guide rail which is provided on the side face of the movable base and has a predetermined curvature radius, a spindle unit support member which is movably disposed along the guide rail and mounts the spindle unit, and an angle adjustment mechanism for moving the spindle unit support member along the guide rail to adjust the angle.

It is desired that the center of the curvature radius of the above guide rail be set to the cutting blade mounting portion of the above rotary spindle. The above angle adjustment mechanism comprises a male screw rod turnably supported to the movable base and a movable female screw block to be screwed to the male screw rod and to be engaged with the spindle unit support member, and the spindle unit support member engaged with the movable female screw block is moved along the above guide rail by turning the male screw rod to move the movable female screw block along the male screw rod. Further, the above angle adjustment mechanism comprises an angle setting block which is selectively and detachably mounted to the movable base and has a support face for placing the spindle unit thereon and supporting it.

DETAILED DESCRIPTION OF THE PREFERRED EMBODIMENTS

A cutting machine according to a preferred embodiment of the present invention will be described in detail with reference to the accompanying drawings.

Figure 1:
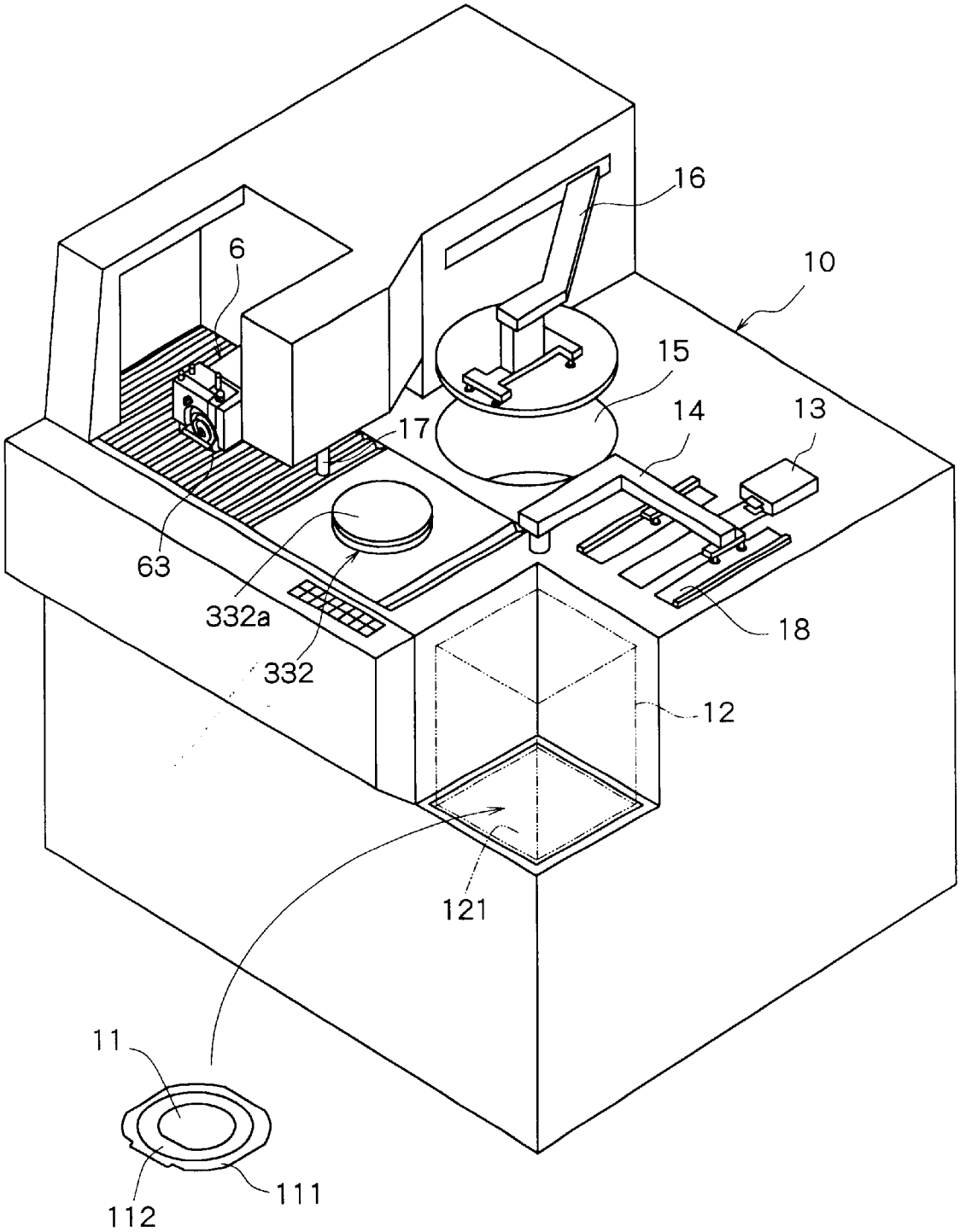
FIG. 1 is a perspective view of a cutting machine constituted according to the present invention.

FIG. 1 is a perspective view of a cutting machine as a dicing machine constituted according to the present invention.

Figure 2:
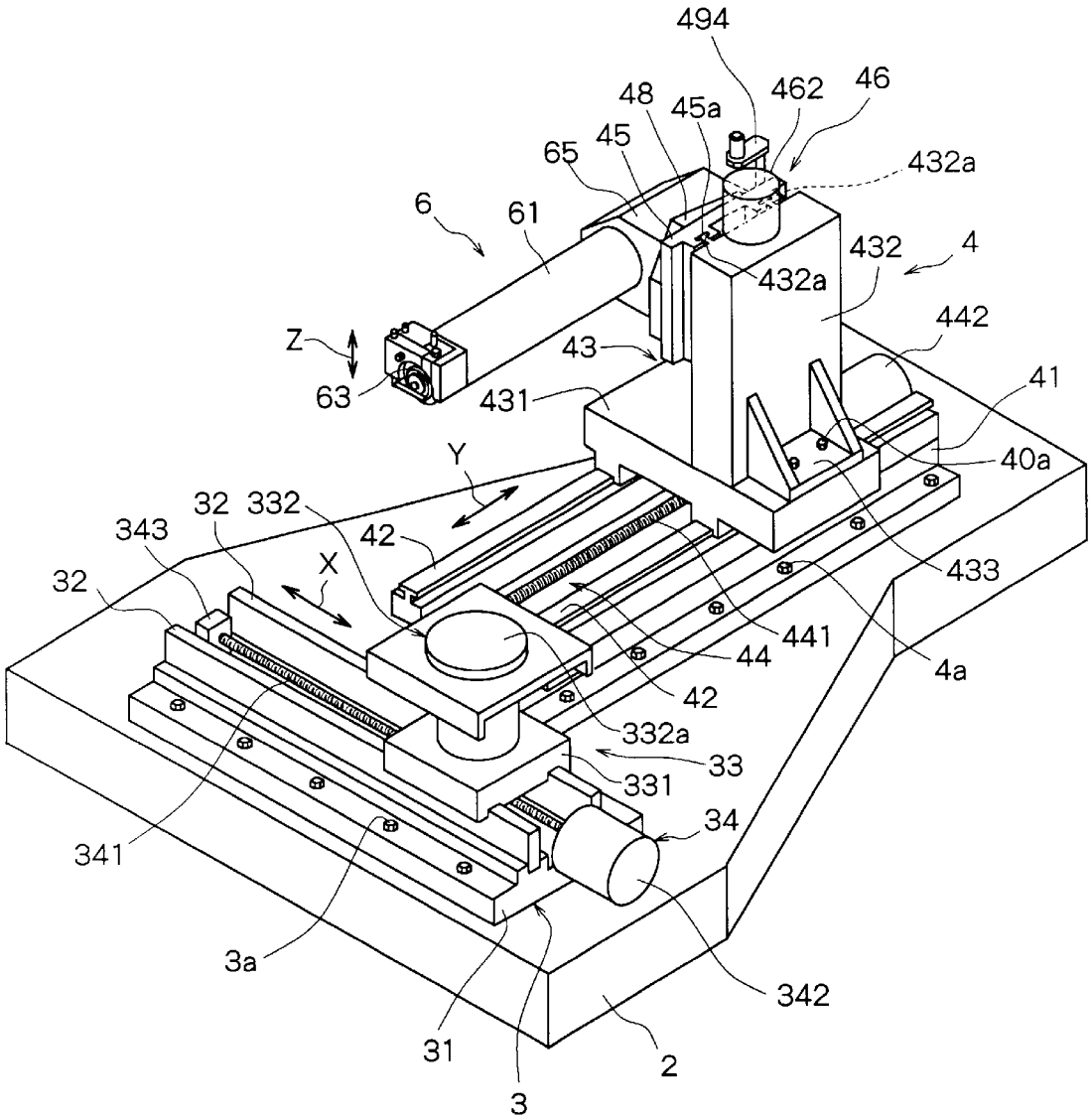
FIG. 2 is a perspective view of the essential section of the cutting machine shown in FIG. 1.

The cutting machine shown in FIG. 1 has a substantially rectangular parallelpiped housing 10. As shown in FIG. 2, the housing 10 comprises a stationary base 2, a chuck table unit 3 disposed on the stationary base 2 in such a manner that it can move in a direction indicated by an arrow X that is a cutting feed direction, and holds a workpiece, a spindle unit support mechanism 4 disposed on the stationary base 2 in such a manner that it can move in a direction (direction perpendicular to the direction indicated by the arrow X that is the cutting feed direction) indicated by an arrow Y that is an indexing direction, and a spindle unit 6 supported by the spindle unit support mechanism 4 in such a manner that it can move in a direction indicated by an arrow Z that is a cutting direction.

The above chuck table unit 3 comprises a support base 31 fixed on the stationary base 2 by a plurality of attachment bolts 3*a,* two guide rails 32, 32 disposed parallel along the direction indicated by the arrow X on the support base 31, and a chuck table 33 disposed on the guide rails 32, 32 in such a manner that it can move in the direction indicated by the arrow X. This chuck table 33 comprises an adsorption chuck base 331 movably mounted on the guide rails 32, 32 and an adsorption chuck 332 which is mounted on the adsorption chuck base 331 and has a workpiece holding face 332*a* at its top, and holds a workpiece, e.g., a disk-like semiconductor wafer on the workpiece holding face 332*a* of the adsorption chuck 332 by a suction means (not shown). The chuck table unit 3 comprises a drive means 34 for moving the chuck table 33 along the two guide rails 32, 32 in the direction indicated by the arrow X. The drive means 34 comprises a male screw rod 341 disposed between the above two guide rails 32, 32 and in parallel to these and a drive source such as a pulse motor 342 for rotatably driving the male screw rod 341. The male screw rod 341 is rotatably supported, at its one end, by a bearing block 343 fixed on the above support base 31 and is transmission-coupled, at its other end, to the output shaft of the above pulse motor 342 through a speed reduction gear that is not shown. The male screw rod 341 is screwed into a female screw through-hole formed in a female screw block (not shown) projecting from the under surface of the center portion of the adsorption chuck base 331 that constitutes the chuck table 33. By driving the male screw rod 341 forward or reverse by the pulse motor 342, therefore, the chuck table 33 can be moved along the guide rails 32, 32 in the direction indicated by the arrow X.

The above spindle unit support mechanism 4 comprises a support base 41 fixed on the stationary base 2 by a plurality of attachment bolts 4*a,* two guide rails 42, 42 disposed in parallel along the direction indicated by the arrow Y on the support base 41, and a movable support base 43 mounted on the rails 42, 42 in such a manner that it can move in the direction indicated by the arrow Y. This movable support base 43 comprises a movable support portion 431 movably mounted on the guide rails 42, 42, and a spindle mounting portion 432 attached to the movable support portion 431. An attachment bracket 433 is fixed to the spindle mounting portion 432 and fastened to the movable support portion 431 by a plurality of attachment bolts 40*a* to mount the spindle mounting portion 432 on the movable support portion 431. The spindle mounting portion 432 is further provided with two guide rails 432*a,* 432*a* extending in parallel to each other in the direction indicated by the arrow Z on the surface opposite to the surface on which the above attachment bracket 433 is mounted. The spindle unit support mechanism 4 has a drive means 44 for moving the movable support base 43 along the two guide rails 42, 42 in the direction indicated by the arrow Y. The drive means 44 comprises a male screw rod 441 disposed between the two guide rails 42, 42 and in parallel to these and a drive source such as a pulse motor 442 for rotatably driving the male screw rod 441. The male screw rod 441 is rotatably supported, at its one end, by a bearing block (not shown) that is secured on the above support base 41 and is transmission-coupled, at its other end, to the output shaft of the above pulse motor 442 through a speed reduction gear that is not shown. The male screw rod 441 is screwed into a female screw through-hole formed in a female screw block (not shown) projecting from the under surface of the center portion of the movable support portion 431 that constitutes the movable support base 43. By driving the male screw rod 341 forward or reverse by the pulse motor 442, therefore, the movable support base 43 can be moved along the guide rails 42, 42 in the direction indicated by the arrow Y.

The spindle unit support mechanism 4 in the illustrated embodiment has a movable base 45 which is movably mounted in the cutting direction perpendicular to the workpiece holding face 332*a* of the adsorption chuck 332 that constitutes the above chuck table 33. On the side face opposite to the above spindle mounting portion 432, this movable base 45 is provided with two to-be-guided rails 45*a,* 45*a* to be slidably fitted to two guide rails 432*a,* 432*a* provided on the spindle mounting portion 432. By fitting the to-be-guided rails 45*a,* 45*a* to the above guide rails 432*a,* 432*a,* the movable base 45 is supported in such a manner that it can move in the cutting direction, that is, in the direction indicated by the arrow Z perpendicular to the workpiece holding face 332*a* of the adsorption chuck 332 that constitutes the above chuck table 33. The spindle unit support mechanism 4 in the illustrated embodiment comprises a drive means 46 for moving the movable base 45 along the two guide rails 432*a,* 432*a* in the direction indicated by the arrow Z. Like the above drive means 34 and 44, the drive means 46 comprises a male screw rod (not shown) interposed between the guide rails 432*a,* 432*a* and a drive source such as a pulse motor 462 for rotatably driving the male screw rod. By driving the male screw rod (not shown) forward or reverse by the pulse motor 462, the movable base 45 can be moved along the guide rails 432*a,* 432*a* in the direction indicated by the arrow Z.

Figure 3:
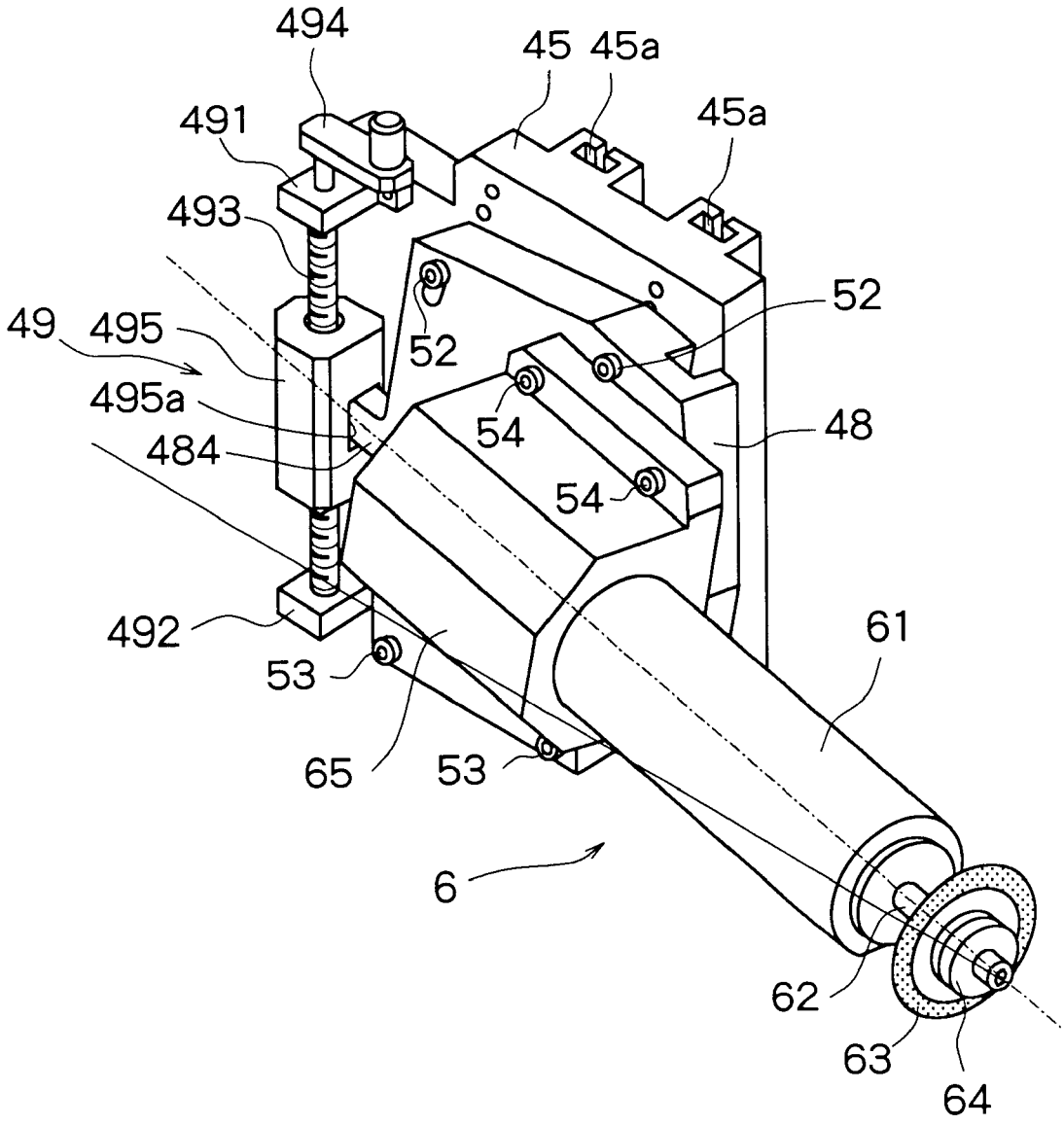
FIG. 3 is a perspective view of the essential section of a spindle unit support mechanism constituting the cutting machine shown in FIG. 1.
Figure 4:
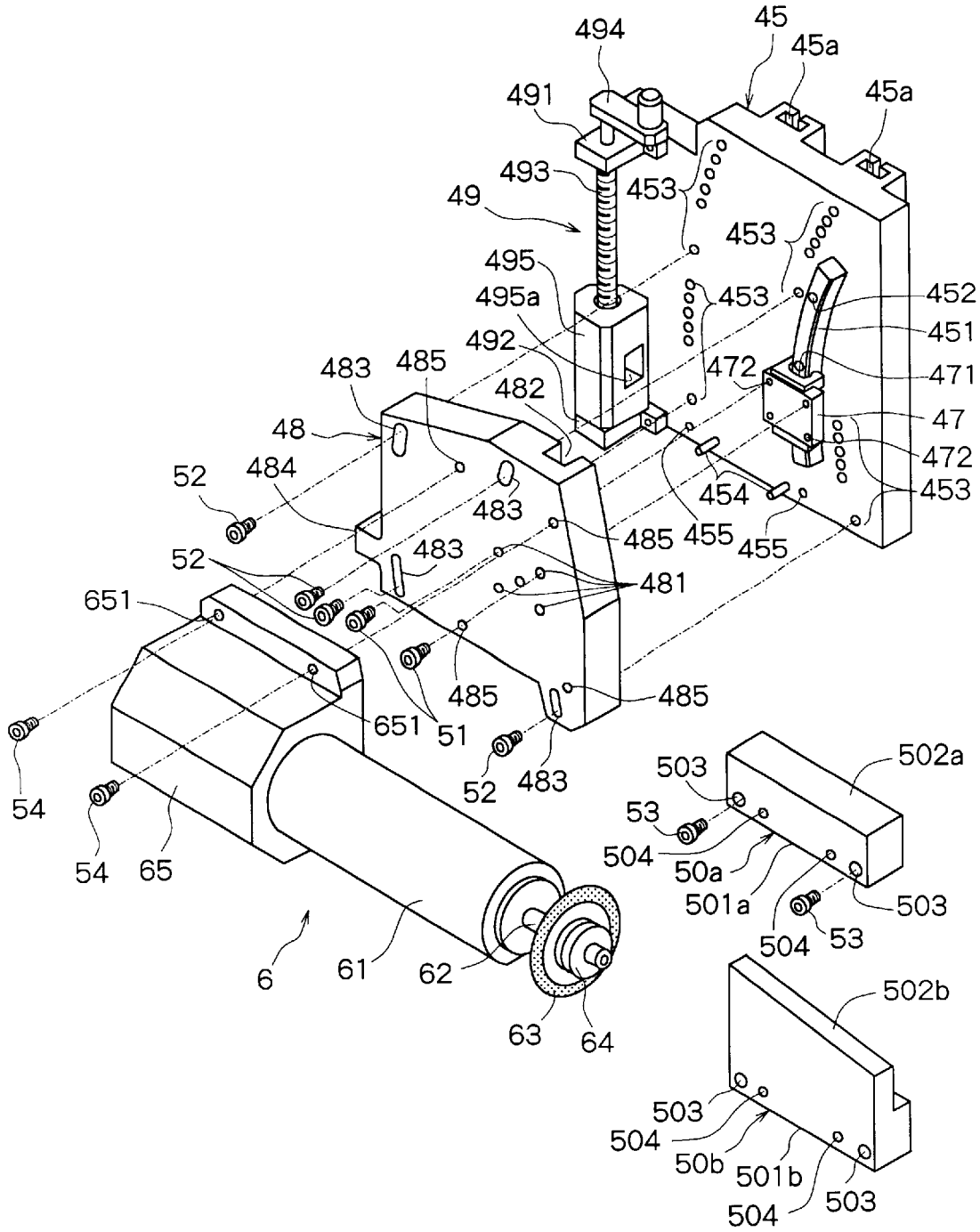
FIG. 4 is an exploded perspective view of the spindle unit support mechanism of FIG. 3.

The above movable base 45 will be described with reference to FIG. 3 and FIG. 4. A guide rail 451 having a predetermined curvature radius is provided on the side face opposite to the side face having the to-be-guided rails 45*a,* 45*a* of the above movable base 45. The center of the curvature radius of the guide rail 451 is set to be the cutting blade mounting portion of a rotary spindle, which will be described later, constituting the spindle unit 6. The guide rail 451 is formed as another part separately from the movable base 45 and mounted to the movable base 45 by a fixing means such as a plurality of fastening bolts 452 in the illustrated embodiment. The thus constituted guide rail 451 is provided with a support block 47 for supporting the spindle unit 6 in such a manner that it can move. The support block 47 is provided, on the side face opposite to the above movable base 45, with a to-be-guided rail 471 to be slidably fitted to the guide rail 451 provided on the movable base 45, and by fitting this to-be-guided rail 471 to the guide rail 451, the support block 47 is supported in such a manner that it can move along the guide rail 451.

A spindle unit support member 48 is connected to the above support block 47 by a plurality of attachment bolts 51. Stated more specifically, the attachment bolts 51 are each inserted into four respective bolt insertion holes 481 formed in the spindle unit support member 48 and screwed into four respective female screw holes 472 formed in the support block 47 to connect the spindle unit support member 48 to the support block 47. A clearance groove 482 for avoiding interference with the above guide rail 451 and the support block 47 is formed in the side face opposite to the support block 47 of the spindle unit support member 48. Four elongated holes 483 are formed in the spindle unit support member 48, and a large number of female screw holes 453 are formed in the movable base 45 at positions corresponding to the areas of the four elongated holes 483. Fastening bolts 52 are inserted into the four elongated holes 483 and screwed into corresponding female screw holes 453 out of the large number of female screw holes 453 to fix the spindle unit support member 48 to the movable base 45. Therefore, when the spindle unit support member 48 is to be moved along the above guide rail 451 together with the support block 47, the fastening bolts 52 are removed, the angle of the spindle unit 6 is adjusted by an angle adjustment mechanism which will be described later and then, the spindle unit support member 48 is fastened and fixed to the movable base 45 with the fastening bolts 52 upon finely adjusting the angle along the elongated holes 483. An engagement projection 484 to be engaged with the angle adjustment mechanism which will be described later is provided on the end face of the spindle unit support member 48. The spindle unit support member 48 may be integrated with the above support block 47.

The spindle unit support mechanism 4 in the illustrated embodiment comprises the angle adjustment mechanism 49 for moving the above support block 47 and the spindle unit support member 48 along the guide rail 451. This angle adjustment mechanism 49 comprises a male screw rod 493 whose upper end and lower end portions are rotatably supported by bearing members 491 and 492 attached to the upper end and lower end portions of the above movable base 45, a handle 494 attached to the top end of the male screw rod 493 and a movable female screw block 495 screwed to the male screw rod 493. An engagement hole 495*a* to be engaged with the engagement projection 484 provided on the above spindle unit support member 48 is formed in the side face of the movable female screw block 495. By engaging this engagement projection 484 with this engagement hole 495*a*, the movable female screw block 495 is not turned even when the male screw rod 493 is turned by the handle 494 and moves in the vertical direction with the rotation of the male screw rod 493.

A plurality of angle setting blocks 50*a*, 50*b* . . . are prepared for the angle adjustment mechanism 49 in the illustrated embodiment. The angle setting block 50*a* has a bottom face 501*a* and a top face 502*a* as a support face which is formed in parallel to the bottom face 501*a* and is used for ordinary cutting in which a cutting blade to be described later is positioned at a right angle to the workpiece holding face 332*a* of the adsorption chuck 332 that constitutes the above chuck table 33. The angle setting block 50*b* has a top face 502*b* as a support face, which is inclined at a predetermined angle to the bottom face 501*b* and is used when the cutting blade which will be described later is positioned at a predetermined tilt angle to the plane perpendicular to the workpiece holding face 332*a* of the adsorption chuck 332 that constitutes the above chuck table 33. A plurality of angle setting blocks having a top face which is inclined at an incline angle to the bottom face are prepared corresponding to the number of set angles. Bolt insertion holes 503, 503 and positioning pin insertion holes 504, 504 are formed in each of the angle setting blocks 50*a*, 50*b* . . . . The two positioning pin insertion holes 504, 504 are formed parallel to the bottom face. A predetermined block is selected from among the thus-constituted angle setting blocks 50*a*, 50*b* . . . and mounted to the movable base 45 by inserting two positioning pins 454, 454 provided on the lower portion of the above movable base 45 into the positioning pin insertion holes 504, 504 and inserting the attachment bolts 53 and 53 into the bolt insertion holes 503, 503 to be screwed into the female screw holes 455, 455 provided in the movable base 45. The above spindle unit support member 48 mounting the spindle unit 6 which will be described later is supported by the top face of the angle setting block. As a result, the spindle unit 6 which will be described later is positioned at the incline angle of the selected angle setting block.

A description is subsequently given of the spindle unit 6. The spindle unit 6 in the illustrated embodiment comprises a spindle housing 61, a rotary spindle 62 which is rotatably supported by the spindle housing 61 and projects from the front end of the spindle housing 61, a cutting blade 63 attached to the top end of the rotary spindle 62, a fixing nut 64 which is screwed to a male screw portion formed at the top end of the rotary spindle 62 to fasten and secure the cutting blade 63 to the rotary spindle 62, and an attachment bracket 65 which is mounted onto the rear end portion of the spindle housing 61 and serves for attaching the spindle unit 6 to the above spindle unit support member 48. The spindle unit 6 is secured to the spindle unit support member 48 by inserting attachment bolts 54 into four bolt insertion holes 651 formed in the attachment bracket 65 and screwing the bolts 54 into four female screw holes 485 formed in the above spindle unit support member 48. The spindle unit 6 has a built-in servo motor as a drive source for driving the rotary spindle 62 in the spindle housing 61.

The spindle unit 6 and the spindle unit support mechanism 4 for supporting the spindle unit 6 are constituted as described above. The adjustment of the support angle of the spindle unit 6, that is, the attachment angle of the cutting blade 63 with respect to the workpiece holding face 332*a* of the adsorption chuck 332 that constitutes the chuck table 33 will be described hereinbelow.

Figure 5:
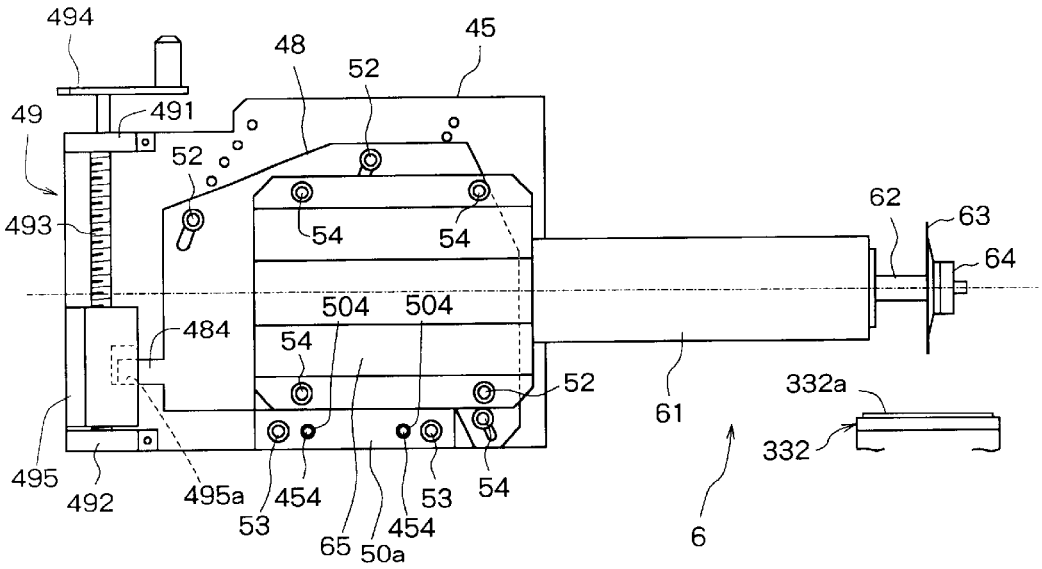
FIG. 5 is a diagram for explaining the first support state of the spindle unit support mechanism shown in FIG. 3.

To carry out the ordinary cutting, as shown in FIG. 5, the angle setting block 50*a* whose bottom face and top face are formed in parallel to each other is attached to the movable base 45 as described above. The spindle unit support member 48 is supported by the top face 502*a* which is the support face of the angle setting block 50*a*. Therefore, the central axis of the rotary spindle 62 of the spindle unit 6 mounted to the spindle unit support member 48 becomes parallel to the workpiece holding face 332*a* of the adsorption chuck 332 that constitutes the chuck table 33, and the cutting blade 63 attached to the rotary spindle 62 is positioned perpendicular to the workpiece holding face 332*a*.

Figure 6:
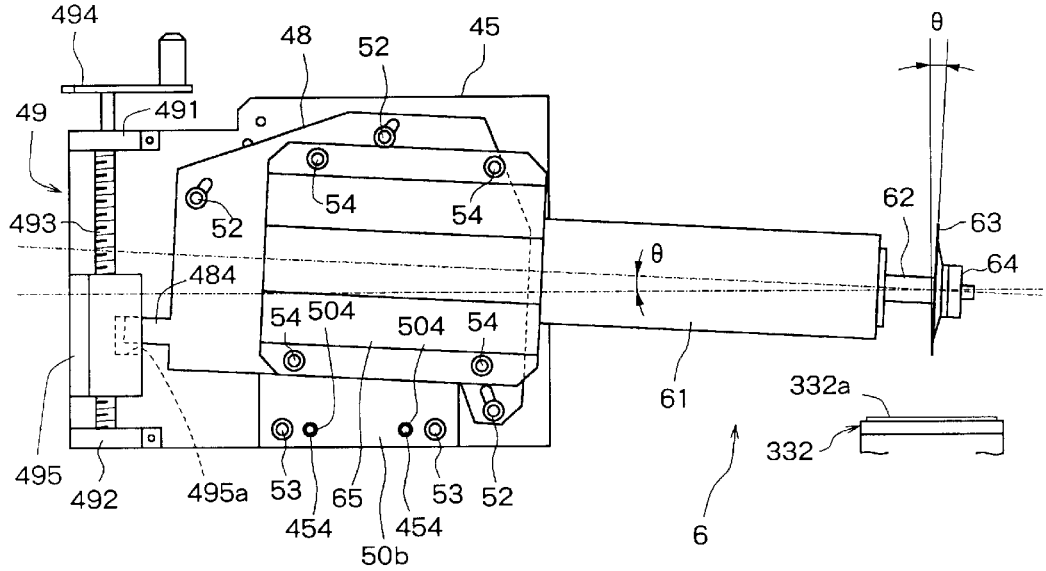
FIG. 6 is a diagram for explaining the second support state of the spindle unit support mechanism shown in FIG. 3.

In order to position the above cutting blade 63 at a predetermined angle to the above workpiece holding face 332*a* from the ordinary cutting state shown in FIG. 5, the fastening bolts 52 are first removed and the handle 494 of the angle adjustment mechanism 49 is operated to turn the male screw rod 493 in one direction, as shown in FIG. 6. When the male screw rod 493 is turned in one direction, the movable female screw block 495 is moved up along the male screw rod 493. As a result, the spindle unit support member 48 whose engagement projection 484 is engaged with the engagement hole 495*a* of the movable female screw block 495 is moved up along the guide rail 451 together with the support block 47. Therefore, a space is produced between the top face of the angle setting block 50*a* and the spindle unit support member 48. Since the spindle unit support member 48 moves along the guide rail 451 having a predetermined curvature radius at this time, the central axis of the rotary spindle 62 of the spindle unit 6 mounted to the spindle unit support member 48 is inclined with respect to the axis parallel to the workpiece holding face 332*a* of the adsorption chuck 392 that constitutes the chuck table 33.

When the spindle unit support member 48 moves up along the guide rail 451 and a space is produced between the top face 502*a* of the angle setting block 50*a* and the spindle unit support member 48 as described above, the angle setting block 50*a* is removed from the movable base 45 and the angle setting block 50*b* whose top face 502*b* as a support surface is inclined at a predetermined incline angle to the bottom face 501*b* is mounted to the movable base 45 as described above. Thereafter, the handle 494 of the angle adjustment mechanism 49 is operated to turn the male screw rod 494 in the opposite direction. When the male screw rod 493 is turned in the opposite direction, the movable female screw block 495 is moved down along the male screw rod 493. As a result, the spindle unit support member 48 whose engagement projection 484 is engaged with the engagement hole 495*a* of the movable female screw block 495 moves down along the guide rail 451 together with the support block 47 and is placed and supported on the top face 502*b* which is the support face of the angle setting block 50*b* as shown in FIG. 6. Then, the fastening bolts 52 are inserted into the four elongated holes 483 and screwed into corresponding female screw holes 453 to fix the spindle unit support member 48 to the movable base 45. As a result, the central axis of the rotary spindle 62 of the spindle unit 6 mounted to the spindle unit support member 48 is positioned in a state of being inclined at a predetermined angle θ to the axis parallel to the workpiece holding face 332*a* of the adsorption chuck 332 that constitutes the chuck table 33. Accordingly, the cutting blade 63 attached to the rotary spindle 62 is positioned at a predetermined incline angle θ to the plane perpendicular to the workpiece holding face 332*a*.

When the spindle unit support member 48 mounting the spindle unit 6 moves along the guide rail 451, in the illustrated embodiment, the position of the cutting blade 63 rarely changes because the center of the curvature radius of the guide rail 451 is set to the mounting portion of the cutting blade 63 of the rotary spindle 62. As a result, it is easy to align the workpiece with the cutting blade 63.

Further, since the spindle unit support member 48 mounting the spindle unit 6 is supported by the angle setting block in the illustrated embodiment, the selected predetermined angle can be stably maintained. In the example of the illustrated embodiment, the spindle unit support member 48 mounting the spindle unit 6 is supported by the angle setting block. However, a predetermined angle may be adjusted by the angle adjustment mechanism 49 only, without using the angle setting block.

Returning to FIG. 1, the illustrated cutting machine comprises a cassette 12 for storing a semiconductor wafer 11 as a workpiece, a workpiece taking-out means 13, a workpiece carrying means 14, a washing means 15, a washing/carrying means 16 and an alignment means 17 which is a microscope or CCD camera. The semiconductor wafer 11 is secured on a frame 11 by a tape 112 and stored in the above cassette 12 in a state of being mounted on the frame 111. The cassette 12 is placed on a cassette table 121 which can be moved up and down by a lifting means that is not shown.

A brief description is subsequently given of the processing operation of the above cutting machine.

The semiconductor wafer 11 in a state of being mounted on the frame 111 stored at a predetermined position of the cassette 12 (the semiconductor wafer 11 in a state of being mounted on the frame 111 will be simply referred to as "semiconductor wafer 11" hereinafter) is moved to a taking-out position by the vertical movement of the cassette table 121 by the lifting means (not shown). Thereafter, the workpiece taking-out means 13 moves back and forth to carry the semiconductor wafer 11 positioned at the taking-out position to a workpiece placing area 18. The semiconductor wafer 11 carried out to the workpiece placing area 18 is carried onto the adsorption chuck 332 of the chuck table 33 constituting the above chuck table unit 3 by the turning movement of the workpiece carrying means 14, and is suction-held on the adsorption chuck 332. The chuck table 33 that has thus suction-held the semiconductor wafer 11 is moved to a position right below the alignment means 17 along the guide rails 32, 32. When the chuck table 33 is positioned right below the alignment means 17, cutting lines formed in the semiconductor wafer 11 are detected by the alignment means 17 to carry out a precision positioning.

Thereafter, the chuck table 33 suction-holding the semiconductor wafer 11 is moved in the direction indicated by the arrow X which is the cutting feed direction so that the semiconductor wafer held on the chuck table 33 is cut along the predetermined cutting lines with the cutting blade 63. That is, the cutting blade 63 is mounted on by the spindle unit 6 which is positioned by being moved and adjusted in the direction indicated by the arrow Y which is the indexing direction and in the direction indicated by the arrow Z which is the cutting direction and is rotatably driven. Accordingly, by moving the chuck table 33 in the cutting feed direction along the lower side of the cutting blade 63, the semiconductor wafer 11 held on the chuck table 33 is cut along the predetermined cutting lines with the cutting blade 63 and divided into semiconductor chips. The divided semiconductor chips are not separated from one another by the action of the tape 112 and hence, the state of semiconductor wafer 11 mounted on the frame 111 are maintained.

At the time of cutting the semiconductor wafer 11 with the cutting blade 63 as described above, when the spindle unit 6 is mounted in such a manner that the central axis of the rotary spindle 62 becomes parallel to the workpiece holding face 332*a* of the adsorption chuck 332 constituting the chuck table 33 as shown in FIG. 5, the semiconductor wafer 11 is cut at a right angle to its surface because the cutting blade 62 attached to the rotary spindle 62 is positioned perpendicular to the workpiece holding face 332*a*. Meanwhile, when the rotary spindle 62 of the spindle unit 6 is inclined at a predetermined angle θ to the axis parallel to the workpiece holding face 332*a* of the adsorption chuck 332 that constitutes the chuck table 33 as shown in FIG. 6, the semiconductor wafer 11 is cut at the predetermined angle θ to its surface because the cutting blade 63 mounted on the rotary spindle 62 is positioned in a state of being inclined at the predetermined angle θ to the plane perpendicular to the workpiece holding face 332*a*. As described above, in the illustrated embodiment, even when the workpiece is to be cut at a tilt angle to the plane perpendicular to its surface, the holding state of the workpiece held on the chuck table 38 is not changed, thereby making it easy to carry out the alignment step for detecting the area to be cut of the workpiece and making it possible to cut the workpiece without re-placing it when the cutting direction is changed by 90°.

After the cutting work of the semiconductor wafer 11 is completed as described above, the chuck table 33 holding the semiconductor wafer 11 is returned to the position where the semiconductor wafer 11 has been first suction-held and release the suction-holding of the semiconductor wafer 11.

Thereafter, the semiconductor wafer 11 is carried to the washing means 15 by the washing/carrying means 16 to be washed. The washed semiconductor wafer 11 is carried out to the workpiece placing area 18 by the workpiece carrying means 14. Then, the semiconductor wafer 11 is stored in the cassette 12 at a predetermined position by the workpiece taking-out means 13.

As described above, according to the present invention, even when the workpiece is cut at a tilt angle to the plane perpendicular to its surface, the holding state of the workpiece held on the chuck table is not changed, thereby making it easy to carry out the alignment step for detecting the area to be cut of the workpiece and making it possible to cut the workpiece without re-placing it when the cutting direction is changed by 90°.

What is claimed is:

1. A cutting machine comprising a chuck table having a workpiece holding face for holding a workpiece, a spindle unit having a rotary spindle for mounting a cutting blade which cuts the workpiece held on the chuck table, and a spindle unit support mechanism for supporting the spindle unit in such a manner that it can move in a cutting direction perpendicular to the workpiece holding face, wherein the spindle unit support mechanism comprises a movable base which is movably disposed in a cutting direction perpendicular to the workpiece holding face, a guide rail which is provided on the side face of the movable base and has a predetermined curvature radius, a spindle unit support member which is movably disposed along the guide rail and mounts the spindle unit, and an angle adjustment mechanism for moving the spindle unit support member along the guide rail to adjust the angle.

2. The cutting machine of claim 1, wherein the center of the curvature radius of the guide rail is set to the cutting blade mounting portion of the rotary spindle.

3. The cutting machine of claim 1, wherein the angle adjustment mechanism comprises a male screw rod turnably supported to the movable base and a movable female screw block to be screwed to the male screw rod and to be engaged with the spindle unit support member, and the spindle unit support member engaged with the movable female screw block is moved along the above guide rail by turning the male screw rod to move the movable female screw block along the male screw rod.

4. The cutting machine of claim 1, wherein the angle adjustment mechanism has an angle setting block which is selectively and detachably mounted to the movable base and has a support face for placing the spindle unit thereon and supporting it.

* * * * *